US010867472B2

(12) United States Patent
Maupas-Oudinot et al.

(10) Patent No.: US 10,867,472 B2
(45) **Date of Patent: *Dec. 15, 2020**

(54) METHOD FOR EXECUTING A COMPUTER GAME SYSTEM

(71) Applicant: LA FRANCAISE DES JEUX, Boulogne-Billancourt (FR)

(72) Inventors: Jean-Baptiste Maupas-Oudinot, Paris (FR); Gersende Egal, Paris (FR); Ludovic Philippe Gremy, Ivry sur Seine (FR); Guillaume Alain Drot, Paris (FR); Olivier Guyot, Malakoff (FR)

(73) Assignee: LA FRANCAISE DES JEUX, Boulogne-Billancourt (FR)

( * ) Notice: Subject to any disclaimer, the term of this patent is extended or adjusted under 35 U.S.C. 154(b) by 8 days.

This patent is subject to a terminal disclaimer.

(21) Appl. No.: 16/228,279

(22) Filed: Dec. 20, 2018

(65) Prior Publication Data

US 2019/0130697 A1 May 2, 2019

Related U.S. Application Data

(63) Continuation of application No. 15/006,170, filed on Jan. 26, 2016, now Pat. No. 10,198,900.

(30) Foreign Application Priority Data

Jan. 28, 2015 (FR) ..... 15 50665

(51) Int. Cl.
*G07F 17/32* (2006.01)

(52) U.S. Cl.
CPC ..... *G07F 17/3225* (2013.01); *G07F 17/329* (2013.01); *G07F 17/3244* (2013.01); *G07F 17/3262* (2013.01); *G07F 17/3267* (2013.01)

(58) Field of Classification Search
USPC ..... 463/17
See application file for complete search history.

(56) References Cited

U.S. PATENT DOCUMENTS 4,652,998 A 3/1987 Koza et al.
8,360,857 B2 * 1/2013 Walker ..... G07F 17/32 463/25

(Continued)

FOREIGN PATENT DOCUMENTS

CN 101894409 A 11/2010
CN 102245271 A 11/2011

(Continued)

OTHER PUBLICATIONS

China Telecom Online Business—2009, "China Telecom online business hall Pay money to smash golden eggs in the prize to send non-stop prize-winning activities," Nov. 8, 2009, accessed at https://freehao123.ddayh.com/624.html (with computer translation).

*Primary Examiner* — Pierre E Elisca
(74) *Attorney, Agent, or Firm* — Davidson, Davidson & Kappel, LLC

(57) ABSTRACT

A method for executing a game implemented by a computer server including performing a plurality of successive instant draws during a game session and calculating winnings at the end of the game session based on the results of the successive instant draws done during the game session is provided. The performance of the successive draws includes initiating a preceding instant draw, saving a result of the preceding instant draw, commanding a display of data based on the result of the preceding instant draw, detecting an action by a player in response to the display of the data, triggering a subsequent instant draw after detecting the action by the player and commanding the display of subsequent data. The subsequent instant draw depends on the preceding instant draw or the action by the player and the subsequent data (Continued)

depends on the subsequent instant draw or the action by the player. A computer program product and computer readable medium are also provided.

7 Claims, 3 Drawing Sheets

(56) References Cited

U.S. PATENT DOCUMENTS

| | | | | |
|---|---|---|---|---|
| 8,398,479 | B2 | 3/2013 | Hardy et al. | |
| 2008/0254853 | A1* | 10/2008 | Wright | G07F 17/329 463/17 |
| 2009/0227318 | A1* | 9/2009 | Wright | G07F 17/32 463/17 |
| 2010/0093419 | A1* | 4/2010 | Wright | G07F 17/32 463/17 |
| 2010/0160024 | A1 | 6/2010 | Breslo | |
| 2011/0124391 | A1 | 5/2011 | Porteaux et al. | |
| 2013/0237304 | A1 | 9/2013 | Oakes et al. | |
| 2014/0045569 | A1 | 2/2014 | Veverka | |
| 2015/0142539 | A1* | 5/2015 | Mueller | G06Q 50/01 705/14.14 |
| 2015/0325079 | A1* | 11/2015 | Alsip | G07F 17/323 463/20 |

FOREIGN PATENT DOCUMENTS

| | | | |
|---|---|---|---|
| EP | 2324893 | A1 | 5/2011 |
| WO | 0205916 | A1 | 1/2002 |
| WO | WO2011014765 | A1 | 2/2011 |
| WO | WO2013190351 | A1 | 12/2013 |

* cited by examiner

METHOD FOR EXECUTING A COMPUTER GAME SYSTEM

This is a continuation of U.S. patent application Ser. No. 15/006,170, filed Jan. 26, 2016, the entire disclosure of which is hereby incorporated by reference herein.

The present invention relates to the field of computer game systems, and more particularly to instant draw game systems.

BACKGROUND

It is possible to provide an instant draw game system implemented by a computer server accessible remotely from a user computer terminal, in which, when the game is initiated by the player, the game system performs an instant draw and awards winnings to the player based on the results of the instant draw, then the game system reveals the result to the player through a script, following a participative script, which may chosen from among a plurality of predetermined scripts, and during which the player is for example asked to perform actions.

SUMMARY OF THE INVENTION

Using several scripts to reveal the winnings makes it possible to make the game more attractive to the player, in particular by giving the player the illusion that the actions he performs during revelation of the winnings affect the final result.

However, the winnings are determined at the time of the instant draw, such that the player's choices only modify the revelation of the winnings, but do not influence the final outcome of the game. After several matches, the player's interest may lessen due to the obvious repetition of the scripts.

It is an object of the present invention is to propose a game system making it possible to preserve the player's interest in the game(s) implemented by the game system.

The present invention proposes a computer game system, comprising a computer server able to implement at least one instant draw game, in which:

the computer server is configured to open a game session allowing a given player to play a given game, the computer server is configured to perform several successive instant draws during a same game session and to calculate winnings for the player at the end of the game session based on the results of the successive instant draws done during the game session, the computer server is configured to trigger a preceding instant draw, to save the result of the preceding instant draw, to command the display of data based on the result of the preceding instant draw, to detect an action by the player in response to the display of the data, to trigger an instant draw following the detection of an action by the player, and to command the display of subsequent data, the subsequent instant draw depending on the preceding instant draw and/or the action by the player, and the subsequent data depending on the following instant draw and/or the action by the player.

According to specific embodiments, the game system comprises one or more of the following features, considered alone or according to any technically possible combination(s):

the computer server is configured to save a game session status after each instant draw and/or each action by the player, the session status of the game containing data relative to the progression of the game;

the computer server is configured to implement each game by executing a corresponding digital game model encoding the rules of the respective game;

each data model contains at least one draw universe, a prize table and rules for awarding prizes;

each game model is a finite-state machine comprising a set of a finite number of statuses and a set of transitions between the statuses;

the computer server comprises at least one game engine able to execute several different digital game models, each game model encoding the rules of a respective game;

the computer server comprises several game models stored in a memory of the computer server and executable by the execution engine of the computer server;

the computer server is configured to store the game session statuses in a memory;

the computer server is configured to resume a game session associated with a game and a player, when the game session is interrupted and the player restarts the game later.

The invention also relates to a method for executing a game implemented by a computer server, comprising performing several successive instant draws during a game session and calculating winnings at the end of the game session based on the results of the successive instant draws done during the game session, the performance of the successive draws comprising the following steps:

initiating a preceding instant draw, saving the result of the preceding instant draw, commanding the display of data based on the result of the preceding instant draw, detecting an action by the player in response to the display of the data, triggering an instant draw after detecting an action by the player, and commanding the display of subsequent data, the subsequent instant draw depending on the preceding instant draw and/or the action by the player, and the subsequent data depending on the subsequent instant draw and/or the action by the player.

BRIEF DESCRIPTION OF THE DRAWINGS

The invention and its advantages will be better understood upon reading the following description, provided solely as a non-limiting example, and done in reference to the appended drawings, in which.

DETAILED DESCRIPTION

Figure 1:
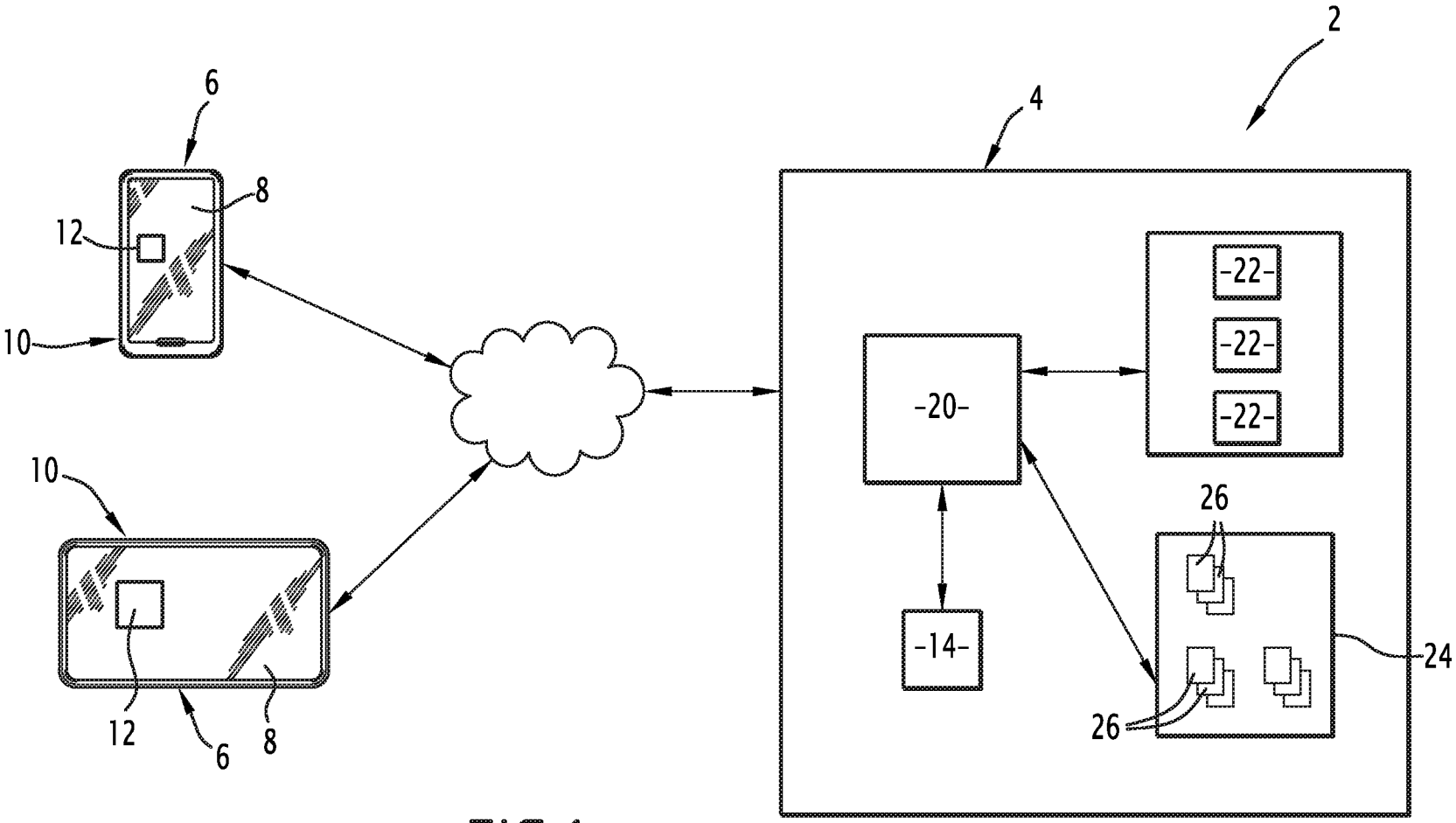
FIG. 1 is a diagrammatic view of a computer game system configured for implementing instant draw games.

The computer game system 2 shown in FIG. 1 comprises a computer server 4 and computer user terminals 6 communicating with the computer server 4 via a communication network.

The computer server 4 is configured to implement at least one instant draw game, preferably several instant draw games. Each user terminal 6 allows a user to interact with the computer server 4 via the communication network to play a game implemented by the computer server 4.

Each user terminal 6 has a display screen 8 for displaying images and a user interface device 10 to allow the user to enter instructions for the images and to send these instructions to the computer server 4 in response to the display. The user interface device 10 for example comprises a pointer device (mouse), a keyboard and/or the display screen 8, which is a touchscreen.

The instructions entered by the user in response to the images displayed on the user terminal 6 are subsequently called "actions".

A user terminal 6 is for example a digital tablet or a computer arranged in a point of sale, a computer belonging to the user, a digital tablet belonging to the user or a telecommunication terminal belonging to the user, for example a smartphone.

Each user terminal 6 comprises a game application 12 program stored in the memory of the user terminal 6 and executable by a processor of the user terminal 6 to allow the user to play a game implemented by the computer server 4 from the user terminal 6.

The computer server 4 is configured so as, at the request of a player made via the game application from his user terminal 6, to open a game session associated with a given game and that given player. During the game session, the player plays the selected game until the player's winnings are determined. The game session ends when the player's winnings are determined.

Each game session comprises executing a sequence of instant draws, the results of which determine the final winnings, taking into account actions by the player between the successive instant draws, each instant draw with a rank greater than or equal to 2 being done based on the preceding draw and at least one action by the player in response to data displayed following the preceding draw.

The final winnings depend on the result of each of the instant draws. The progression of the game and/or the final winnings depend on the results of the various instant draws, and optionally their sequence. During a game session, the result of each instant draw—or at least the results of each instant draw preceding the last instant draw of the game session—is saved in order to take the progression of the game into account and/or to take at least one subsequent instant draw of the game session into account.

The computer server 4 is configured to perform a series of successive instant draws during a game session, and to save the results of each instant draw of the game session—or at least the result of each instant draw preceding the last instant draw of the game session.

Each instant draw is done in a draw universe. A draw universe is a list of elements. Each instant draw corresponds to the random selection of an element from the list of elements.

It is possible to perform a draw without replacement, in which the drawn element is removed from the list for a subsequent draw, or a replaced draw, in which the characteristics of the drawn element are saved and the element is once again included in the list of elements for a new subsequent instant draw done in the same list of elements.

The computer server 4 comprises a hazard generator 14 making it possible, for each draw in a draw universe, to select an element of the draw universe at random.

The computer server 4 is configured to perform, during a same game session, at least one subsequent instant draw based on an action by the player performed in response to a preceding draw, in particular after revealing the result of that preceding draw.

The computer server 4 is configured to trigger a first draw, then to save the result of the first draw in a computer memory and order the display of first data based on the result of the first draw, then to detect an action by the player in response to the display of the first data, then trigger a subsequent second draw, then save the result of the first draw in a computer memory and command the display of second data, the second draw depending on the result of the first draw and/or the action by the player, and the second image depending on the result of the first draw, the result of the second draw and/or the action by the player.

The displayed data are for example displayed in the form of images, for example images comprising one or more elements that can be selected by a player or one or more data entry fields.

An action by the player is a simple action, such as the selection of a single element of the displayed image, or a complex action comprising several simple actions, such as selecting a combination of elements of the displayed image.

In one embodiment, the action by the player comprises at least one selection of at least one displayed element from among a plurality of elements displayed during the display of the first data, and selectable by the player.

In one embodiment, the action by the player comprises entering a datum in at least one entry field.

In one embodiment, the action by the player comprises one or more selections, each corresponding to a choice by the player associated with the game and/or the entry of one or more data, before triggering the subsequent instant draw, depending on the or each selection and/or the or each entered datum.

The action is performed by the player via the user terminal 6. The action by the player is detected by the user terminal 6 and sent to the computer server 4, which continues the execution of the game based on this action by the player.

The computer server 4 is configured to update and save a game session status following each instant draw and/or each action by the player. The game session status contains data relative to the progression of the game. The game session status depends on the results of each instant draw already done and each action by the player already done during the game session. The game session status saved after an instant draw contains the result of that instant draw.

In one embodiment, the draw universe, the prize table and the rules for awarding prizes associated with an instant draw depend on the result of at least one preceding instant draw and/or preceding actions by the player, depending on predetermined rules of the game in progress. For example, an action by the player consists of choosing between two different draws to be followed, such that the subsequent draw is that chosen by the player due to this action.

It is possible for a game session to be interrupted. A game session is for example interrupted when the player intentionally interrupts the game session and disconnects the user terminal 6 from the computer server 4, or when the user terminal 6 loses the connection with the computer server 4.

Saving the game session status after each instant draw and/or each action by the player during a game session makes it possible to resume an interrupted game session.

The computer server 4 is configured to propose to the player to resume an interrupted game session when the player connects to the computer server 4 and selects a game for which this player already has a game session that has been started, but interrupted before the end of the game session.

At the end of a game session, the computer server 4 is configured to calculate the player's winnings based on the successive instant draws done during the game session.

The score is therefore calculated after several successive instant draws, and based on an action by the player in response to the display of displayed data as a function of the result of at least one instant draw, before a subsequent instant draw done as a function of the result of the preceding draw and/or this action.

Each game has encoded rules executed by the game system 2 during a game session. The rules of the game for example comprise at least one draw universe, a prize table and reward rules.

In one embodiment, a game comprises a single draw universe and an associated prize table. The game for example includes several successive draws in the same game universe, with or without replacement.

An instant draw prize is for example an amount, a right to participate in another game, a winnings multiplier for a subsequent instant draw of the same game, a number of subsequent instant draws in a draw universe, a virtual object, the final winnings depending on a combination of drawn virtual objects, etc.

At the end of a game session, the player may decide to be paid the amount of any winnings, or to credit his winnings to an account that he has with the game provider, from which he can purchase new game sessions from the game provider or be paid his winnings. Other possible uses of the winnings can be considered.

The computer server 4 comprises a game execution core or game engine 20, in the form of a software application configured to execute digital game models 22, each game model corresponding to a respective game and each game model encoding the rules of the game.

The game engine 20 is able to call on the hazard generator 14 during the execution of each game model 22, to perform instant draws during each game session.

The game engine 20 is able to execute several game sessions in parallel implementing a same game model or several separate game models.

The computer server 4 comprises a database 24 of game sessions 26 in progress in which all of the game sessions in progress are stored, i.e., which have not been completed because the player is in the process of playing or because the game session was interrupted.

Figure 2:
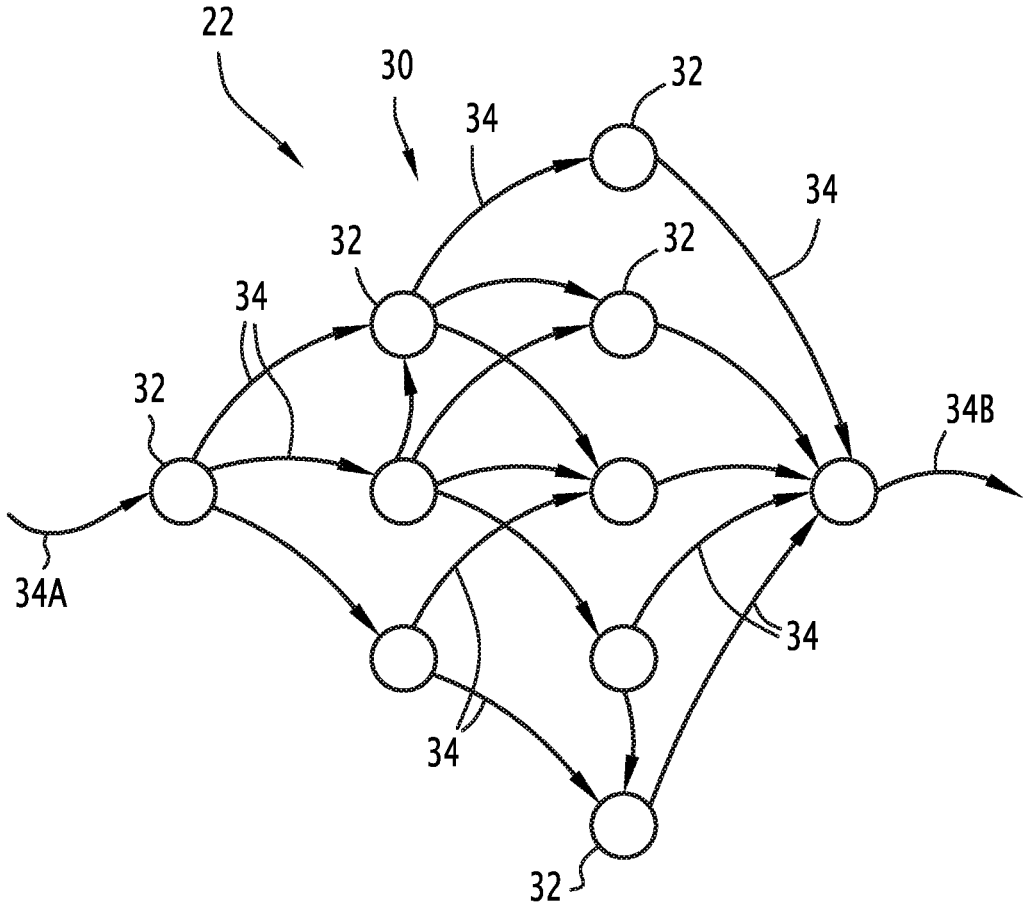
FIG. 2 is a diagrammatic view of a game model implemented by the game system.
Figure 3:
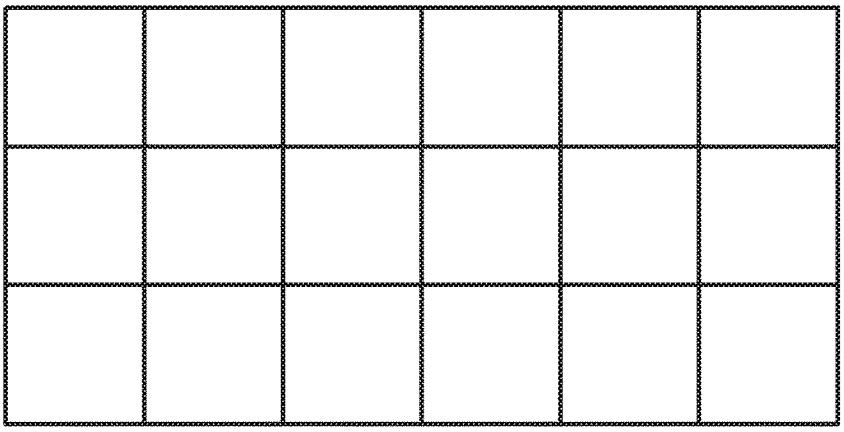
FIGS. 3 to 6 are diagrammatic views of images displayed by the game system during the implementation of an instant draw game according to one illustrative example.
Figure 4:
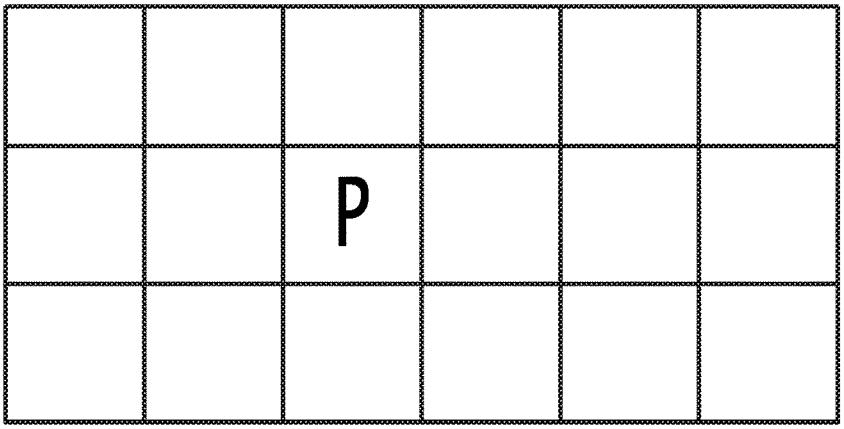
Figure 5:
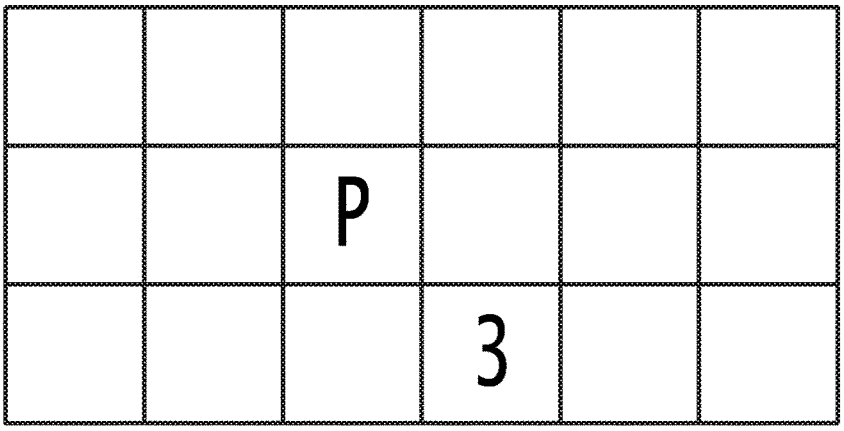
Figure 6:
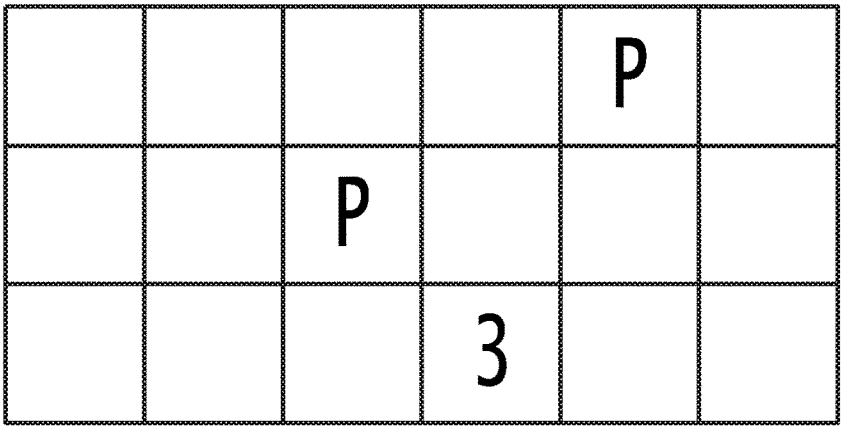

As illustrated in FIG. 2, each game model 22 comprises a finite-state machine 30 (or status machine) comprising a plurality of possible statuses 32 in a finite number and a plurality of transitions 34, each transition 34 initiated from a status 32 causing the finite-state machine 30 to remain in the current state or to transition the finite-state machine 30 to a state.

The finite-state machine 30 comprises an input transition 34A corresponding to the opening of a game session, and at least one output transition 34B, each output transition corresponding to the end of the game session.

The statuses 32 of the finite-state machine 30 correspond to the different situations that the player may achieve based on the results of instant draws and/or actions by the player during a game session. A status 32 of the finite-state machine at least corresponds to an image to be displayed.

Each transition 34 corresponds to a result of an instant draw and/or an action by the player. During the execution of the game model 22, the result of each draw and/or each action by the player triggers a transition 34.

The game engine 20 is able to command saving of the game session status associated with a game session after each draw and/or each action by the player. At a given moment of the game session, the status of the game session corresponds to the status of the finite-state machine 30 of the game model 20.

The game engine 20 is able to execute a game session based on the finite-state machine 30 modeling the game and the associated game session status.

This configuration of the computer server 4 makes it possible to implement different games that are very heterogeneous, but based on instant draws, from the same computer server 4, and in particular the same game engine 20. Each game is implemented according to a game model 22 executable by the game engine 20.

In a game, several successive instant draws can be instant draws with or without replacement in the same universe. It is possible to provide games with instant draws in the universe providing access to different draws each with their own universe based on the result of the first draw, and so forth.

It is possible to provide draws with dynamic universes whereof the number of elements where the probability of drawing an element depends on the result of a preceding instant draw, for example if the preceding instant draw allows the user to win a bonus allowing him to improve his likelihood of a favorable draw on a subsequent instant draw.

One example game model implemented by the game system 2 is illustrated in FIGS. 3 to 6, each of these figures illustrating a step of the game.

Here, the game is based on a matrix of 6×3 boxes, in which the player must successively select three boxes. In practice, the player performs a sequence of three successive draws without replacement in a draw universe. Each selection of a box triggers a respective instant draw and display of data, here in the form of a new image, based on the selected box and the result of the draw. The universe of the image is updated after each draw to remove the elements that have already been drawn.

The initial draw universe U1 is formed from the following list of eighteen elements: 1, 3, 5, B, P, P, P, P, P, P, P, P, P, P, P, P, P, P, where 1 represents winnings of one unit, 3 represents winnings of three units, 5 represent winnings of five units, B represents a bonus and P represents a loss. The bonus is for example a right to perform an extra draw.

Upon opening a game session, the computer server 4 commands the display on the user terminal 6 of a first image (FIG. 3) in which the matrix appears, the content of the boxes being hidden.

The player selects box (3; 2). Upon detection of the action by the player, the computer server 4 initiates a draw in the draw universe U1 resulting in an element P.

The computer server 4 commands the display of a second image (FIG. 4) containing the matrix in which the result of the draw, i.e., the element P, appears in the first selected box (3; 2).

The computer server 4 updates the draw universe for the following draw, which is henceforth the draw universe U2 made up of the following seventeen elements: 1, 3, 5, B, P, P, P, P, P, P, P, P, P, P, P, P, P.

The player selects box (4; 3). Upon detection of the action by the player, the computer server 4 initiates a draw in the draw universe U2 resulting in an element 3.

The computer server 4 commands the display of a third image (FIG. 5) containing the matrix in which the result of the draw, i.e., the element 3, appears in the second selected box (4; 3).

The computer server 4 updates the draw universe for the following draw, which is henceforth the draw universe U3 made up of the following sixteen elements: 1, 5, B, P, P, P, P, P, P, P, P, P, P, P, P, P.

The player selects box (5; 1). Upon detection of the action by the player, the computer server 4 initiates a draw in the draw universe U3 resulting in an element P.

The computer server 4 commands the display of a fourth image (FIG. 6) containing the matrix in which the result of the third draw, i.e., the element P, appears in the third selected box (4; 3).

At each step of the game, i.e., after each draw or each action by the player, the computer server 4 saves the session status of the game. Thus, during the game session, the computer server 4 saves the results of the different successive draws and uses these results for the continuation of the game session.

The final winnings are not determined by a single instant draw of three elements in the game universe upon opening a game session, followed by a scripted presentation of the result, but by three successive instant draws, the sequence and results of which determine the final winnings of the player, with data displays following the successive draws, and the detection of actions by the players and the triggering of instant draws based on those actions.

The game example of FIGS. 3 to 6 is relatively simple. Very different, more complex, more strategic games, based on sequences of successive instant draws, can be designed.

Thus, the game system 2 configured to perform several successive draws in a same game session makes it possible to propose a large number of varied games able to arouse players' interest.

The draws done based on the actions by the player between successive draws make it possible to increase the interactivity and improve the gaming experience for the player. Thus, the player is actively involved in the game play, and must perform actions in order to complete the game session.

In the case of a single predetermined instant draw determining the final winnings, a single draw is done upon opening the gaming session and determines the final winnings, actions by the player only being performed during a scripted presentation, having no impact on the final outcome. In this case, a player can open the session, which triggers the draw and the award of the winnings to the player's account, immediately leave the session before the scripted presentation of the outcome, and look at his account later to see whether it has been credited with winnings.

On the contrary, in the game system according to the invention, the player absolutely must perform actions for the game session to advance and to determine the final winnings. As a result, the game session is more interactive, lasts longer, and is less disappointing in case of loss of the starting bet, since the loss only occurs after actions by the player.

The game system 2 is flexible and makes it possible to offer players new games in a simple manner. A new game can be programmed very easily by establishing a finite-state machine that will be implemented by the game engine. The new games can be implemented and distributed quickly on the computer server 4.

During a game session, the draws are done instantly. No draw is predetermined. The game system 2 limits the risks of collusion.

The results of the draws are persistent in the game system 2. Indeed, the result of a preceding draw is saved and the subsequent draw can for example depend on the result of the preceding draw, or depend on an action by the player following the preceding draw, the result of the game for example depending on the combination of two draws.

Furthermore, because several successive draws are done, the game session status is saved to be able to continue the game session in case of an intentional or unintentional interruption.

In general, the invention relates to a game system 2 configured to save, during a game session, the result of an instant draw and to perform a subsequent instant draw that may depend on the saved result, the final winnings being determined by the results of the instant draws done during the game session.

Furthermore, the game system 2 based on an architecture comprising a computer server 4 comprising a game engine and digital game models stored in a memory of the computer server 4 and executable by the game engine for the execution of a game, allows easy implementation of various games.

Thus, in general, the invention relates to a game system 2 from implementing games, comprising a computer server 4 including a game engine and digital game models stored in a memory of the computer server 4, each game model being executable by the game engine to run a respective game, preferably an instant draw game.

What is claimed is:

1. A computer implemented method for executing a game implemented by a computer server configured for communicating with a computer user terminal via a communication network to allow a player at the computer user terminal to play the game implemented by the computer server, comprising performing a plurality of successive instant draws communicated from the computer server to the computer user terminal via the communication network during a game session and calculating winnings at the end of the game session based on the results of the successive instant draws done during the game session, the performance of the successive draws comprising the steps of:

initiating, by the computer server, a preceding instant draw;

saving a result of the preceding instant draw to the computer server;

commanding a display of data on the computer user terminal via the communication network based on the result of the preceding instant draw;

detecting an action input into the computer user terminal by the player in response to the display of the data;

triggering, by the computer server, a subsequent instant draw after detecting the action by the player; and commanding the display of subsequent data on the computer user terminal based on the subsequent instant draw;

the subsequent instant draw depending on the preceding instant draw or the action by the player, and the subsequent data depending on the subsequent instant draw or the action by the player.

2. The method of claim 1, wherein each game is implemented by executing a corresponding digital game model encoding the rules of this game, each game model being a finite-state machine comprising a set of a finite number of states and a set of transitions between the states, the states corresponding to the different situations that the player may achieve based on the results of instant draws or actions by the player during a game session, each transition corresponding to a result of an instant draw or an action by the player triggering this transition.

3. The method of claim 1, wherein the computer server includes a random generator for performing the plurality of successive instant draws at random.

4. The method of claim 1, further comprising the step of distributing the winnings at the end of the game session.

5. A computer program product comprising software instructions which, when executed by a computer, implement the method as recited in claim 1.

6. A non-transitory computer readable medium comprising a computer program including software instructions which, when executed by a computer, implement the method as recited in claim 1.

7. A computer implemented method for executing a game by a computer configured for communicating with a computer user terminal via a communication network to allow a player at the computer user terminal to play the game implemented by the computer, the computer performing a plurality of successive instant draws communicated from the computer to the computer user terminal via the communication network during a game session and calculating winnings at the end of the game session based on the results of the successive instant draws done during the game session, the performance of the successive draws comprising the steps of:

initiating, by the computer, a preceding instant draw;

saving a result of the preceding instant draw to the computer;

commanding a display of data on the computer user terminal via the communication network based on the result of the preceding instant draw;

detecting an action input into the computer user terminal by the player in response to the display of the data;

triggering, by the computer, a subsequent instant draw after detecting the action by the player; and commanding the display of subsequent data on the computer user terminal based on the subsequent instant draw;

the subsequent instant draw depending on the preceding instant draw or the action by the player, and the subsequent data depending on the subsequent instant draw or the action by the player.

* * * * *